US006976648B2

(12) United States Patent
Chang

(10) Patent No.: US 6,976,648 B2
(45) Date of Patent: Dec. 20, 2005

(54) STRIP/CROSS SWITCH MECHANISM OF DOUBLE-DUTY SHREDDER

(76) Inventor: Frank Chang, 3/F., No. 200, Xinyi Road, Section 3, Taipei (TW) 106

( * ) Notice: Subject to any disclaimer, the term of this patent is extended or adjusted under 35 U.S.C. 154(b) by 121 days.

(21) Appl. No.: 10/338,913

(22) Filed: Jan. 9, 2003

(65) Prior Publication Data

US 2004/0134762 A1 Jul. 15, 2004

(51) Int. Cl.[7] ..... B02B 5/02
(52) U.S. Cl. ..... 241/101.2; 241/236; 192/24
(58) Field of Search ..... 241/101.2, 236; 192/24, 28, 69, 69.3, 69.7, 69.9; 474/4, 148; 74/405

(56) References Cited

U.S. PATENT DOCUMENTS 4,566,566 A * 1/1986 Vuillet ..... 192/24
4,785,925 A * 11/1988 Frisbie et al. ..... 192/17 R

* cited by examiner

*Primary Examiner*—Derris H. Banks
*Assistant Examiner*—Jason Y Pahng
(74) *Attorney, Agent, or Firm*—Dennison, Schultz, Dougherty & MacDonald

(57) ABSTRACT

The present invention is a strip/cross switch mechanism of double-duty shredder, consists of two main bodies, machine drive device and switch knob device, wherein, machine drive device comprises: motor drive gear wheel, drive shaft, shaft coat, large strap wheel, ratchet wheel, drive key, pawl, pawl wheel, and the switch knob device consists of fork, knob arm, fork frame and knob, the rotary knob change the position of fork to make large strap wheel compel drive key move to the position that pawl and ratchet wheel disposed, when derive key intermeshes with pawl the ratchet wheel that pawl affiliated to and the fixed drive shaft of ratchet wheel will be rotated to rotates latitude paper-cutting mechanism drivingly connected to drive shaft to cut the paper to be cut in latitudinal direction.

1 Claim, 5 Drawing Sheets

STRIP/CROSS SWITCH MECHANISM OF DOUBLE-DUTY SHREDDER

FILED OF THE INVENTION

The present invention is a double-duty shredder, especially a strip/cross switch mechanism of double-duty shredder that can change different effect of strip-cut or cross-cut.

BACKGROUND OF THE INVENTION

Shredder, just as its name implies, a machine that cut paper into chips by mechanical cut, the more important object is to destroy the content on the paper and to keep security, besides to cut the paper into chips to decrease the quantity of the garbage to protect environment.

Shredder can be classed into two types, the stripe-cut shredders and cross-cut shredders, according to the machine cut style, the former is set blades used for cutting on revolving cut wheel to cut paper into strips, the later is the blades being provided with more than one hook-shaped edges and the edges are disposed helically around the revolving cut wheel to cut paper into strip longitudinally and cut paper into shatter of 5 mm×40 mm in latitudinal direction. Because the cut effect of later is better than the that of former, so, as to the object of environmental protection of decreasing the quantity of garbage or the effect of keep security of destroying the contents on the paper, the cross-cut shredders has become the main flow of the market. Just because the cross-cut shredders cut paper more tinny, so the motor that provide the drive revolving cut wheel must more powerful than that of stripe-cut shredders. Besides because the blade used for cutting of stripe-cut shredders is provided with more than one hook-shaped edges, to avoid accidentally injure operator on the circumstance of the current is not break, so ISO have a regulation that the shredders must have safe activation switch, namely, cross-cut shredders act only on the condition that be set on the fixed position of garbage container provided with manufacture, on the contrary, if the shredders being removed from the garbage container the current will be broken. So, as to the cross-cut shredders, shredders and the garbage container must be provided to consumers. But the regulation is not applied to stripe-cut shredders, so stripe-cut shredders can be sold lonely not plus compulsively garbage container, so the consumers who want not have a additional garbage or manufactures who want not increase the packing volume of suitable garbage container and transport cost, the garbage will be provided to consumers as a non-compulsive suitable object.

SUMMARY OF THE INVENTION

Whereas those mentioned above, the inventor think of the possibility to combine cross-cut shredder and strip-cut shredder into a unit, and invent a strip/cross of double-duty shredder through long time study and test. How to make double-duty shredder produce strip or cross paper-cutting mode by switch act is the important problem that the double-duty shredder can be commercial.

The invention provides a strip/cross switch mechanism of double-duty shredder aims to above subject, can change different effect of strip or cross paper-cutting mode.

Scilicet, the object of the present invention is to provides a strip/cross switch mechanism of double-duty shredder that switch control drive key, pawl, ratchet wheel and drive shaft rotate together or to decide the paper to be cut will be cut by the strip paper-cutting mode or cross paper-cutting mode by tidy effective mechanical drive device.

DESCRIPTION OF THE PREFERRED EMBODIMENT

Figure 1:
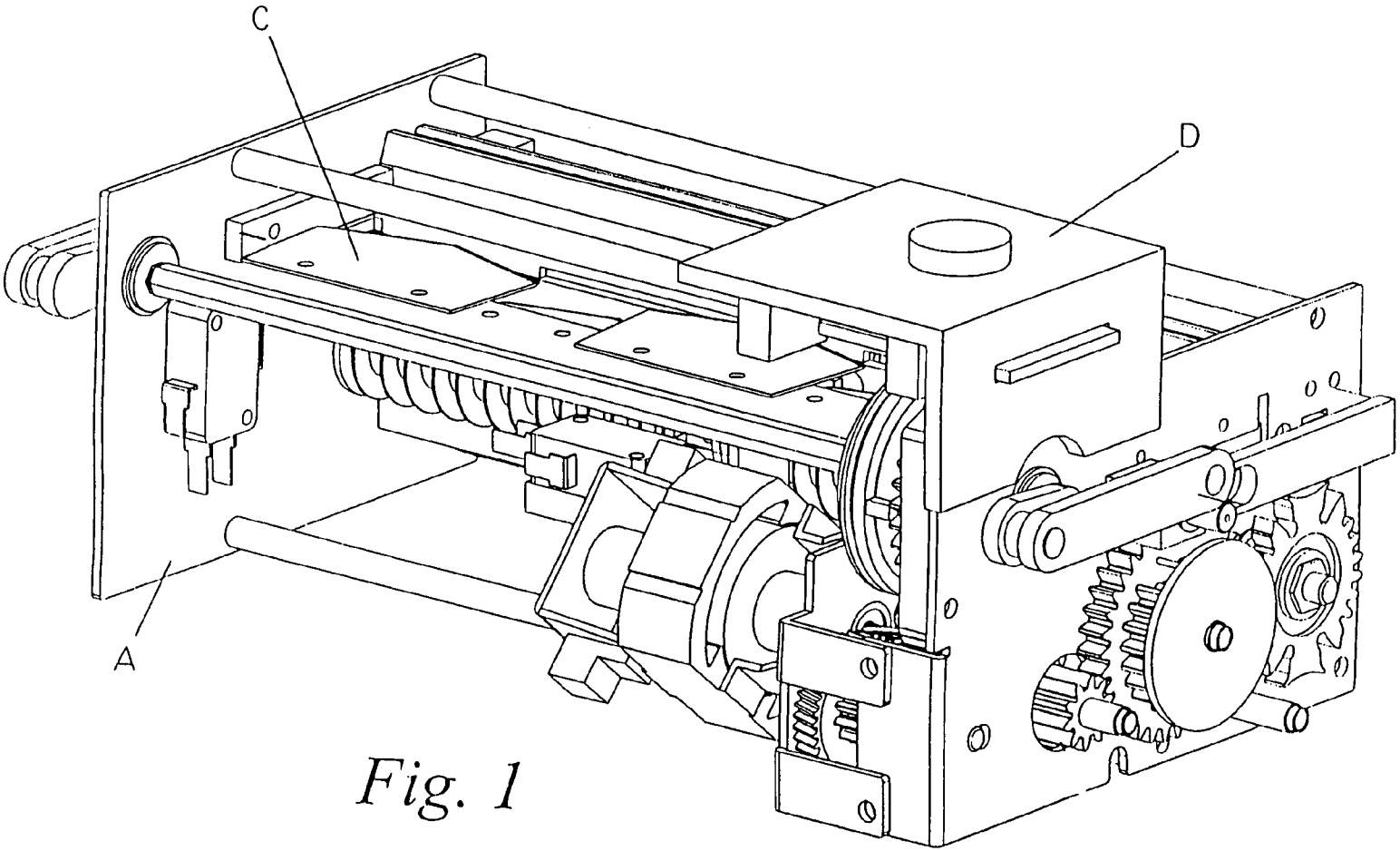
FIG. 1 is perspective view of outline of double-duty shredder.
Figure 2:
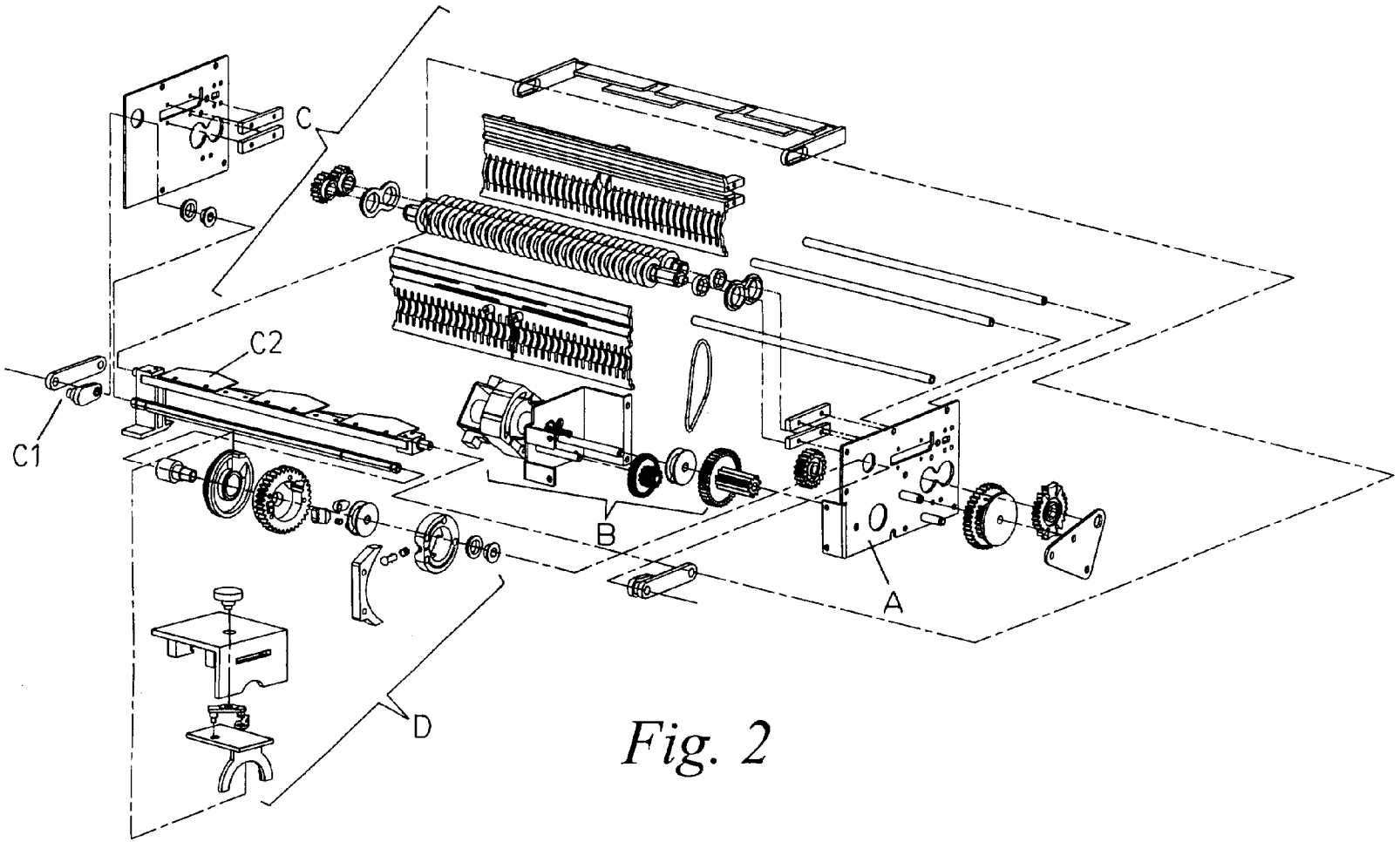
FIG. 2 is a general view of parts of double-duty shredder.

Referring now to FIG.1, the perspective view of the outline of the double-duty shredder is illustrated, and referring to FIG. 2, the view of general parts of the double-duty shredder is illustrated, wherein the double-duty shredder consists of main body A, motor drive mechanism B, linkage mechanism of latitude paper-cutting/longitude paper-cutting and anti-block C, and strip/cross switch mechanism D.

Figure 3:
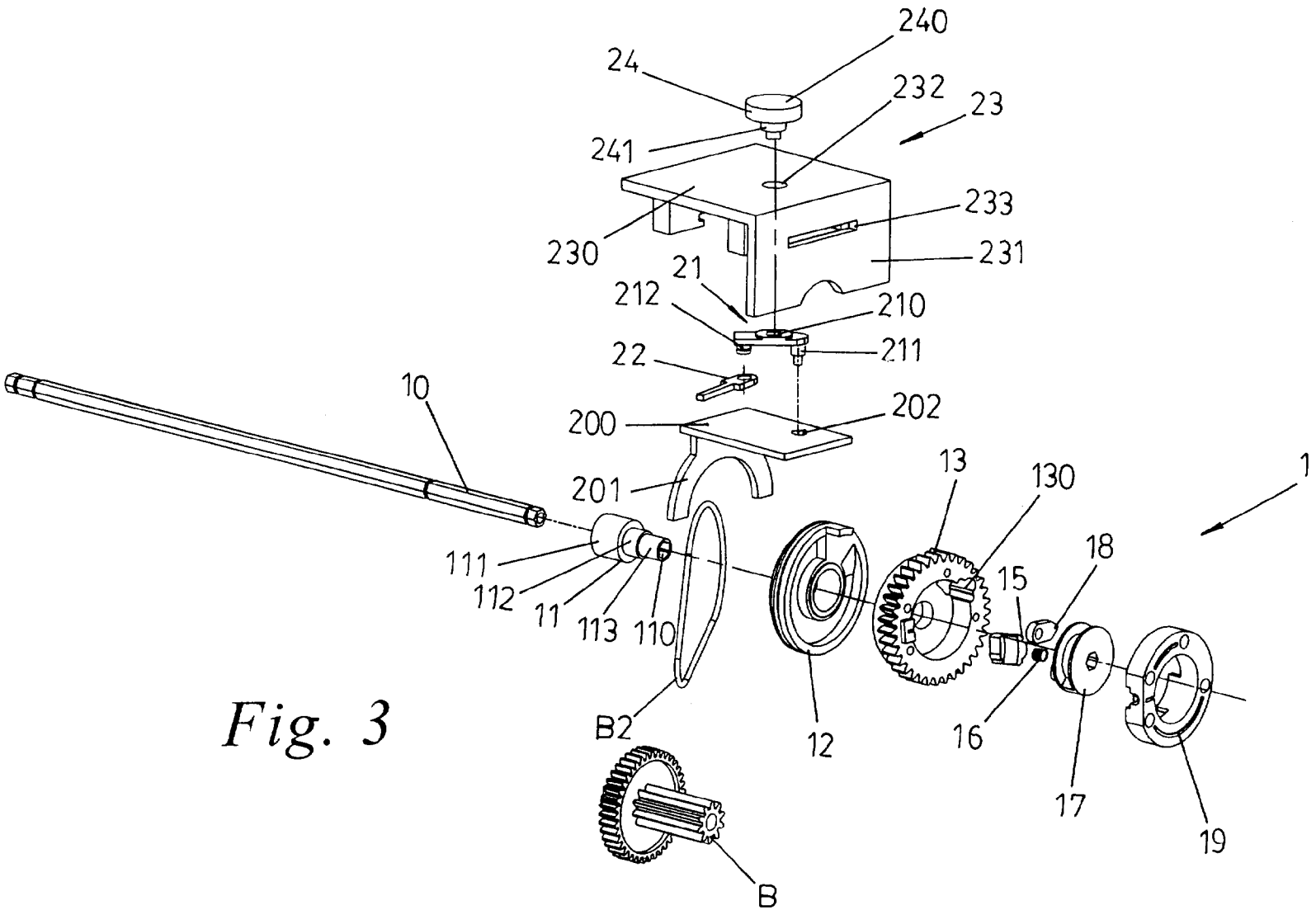
FIG. 3 is an exploded perspective view of the present invention.

Referring to FIG. 3, which illustrates an exploded perspective view, the present invention encompasses a strip/cross switch mechanism of double-duty shredder comprising a mechanical drive device 1 and a switch knob device 2, motor drive mechanism B, which is the power source of the present mechanism by transferring power of the motor, the left side of which is provided with a strap wheel B1 rotate synchronically with the drive gear.

A drive shaft 10, which is an axostyle with a multangular section, the two ends of which connected with latitude paper-cutting device C2 into a linkage mechanism by crank coupler link device C1;

A shaft coat 11 provided with a shaft hole 110 with multangular section corresponding to the axostyle with a multangular section of drive shaft rotate with drive shaft 10, the outline of which is step style consisting of large diameter part 111, middle diameter part 112 and small diameter part 113 from left to right;

A large strap wheel 12 disposed on the large diameter part 111 of shaft coat 11 and can slip from left to right, rotate with motor drive gear wheel B to same direction by strap B2 get the rotate power from the small strap wheel B1 disposed on the left side of motor drive wheel B;

A ratchet wheel 13 disposed on the middle diameter part 112 of shaft coat 11, get rotate power from motor drive wheel B by idler wheel 14 to make ratchet wheel 13 rotate in the same direction as motor drive mechanism B, the inner circle of which is pre-provided with a through keyway 130.

A drive key 15 disposed and can glide in said through keyway 130, the right of which against a compressed spring 16;

A pawl wheel 17, the shaft hole with a multangular section on the center of which is fixed to the axostyle with a multangular section of drive shaft 10, the left of which is provided with a pawl 18 corresponding to the position of said drive key 15;

A head cover 19, that is an encasement for pawl wheel 17, is the right end wall of the present mechanism;

Wherein, switch knob device 2 consists of:

A fork 20 comprising a flat plate 200 and a half-circular fork frame 201, the flat plate 200 is provided with a groove hole 202, and the half-circular fork frame 201 against the left side of said large strap wheel 12;

A switch knob arm 21 having an inveted U-shaped configuration, is provided with a long-hole groove 210, the left supporting arm 200 through groove hole 202 disposed on the flat plate 200 of the fork 20, the right supporting arm 212 fixed on a switch knob plate 22 acts as a fixed pivot.

A fork frame 23 disposed upon the said fork 20 and switch knob arm 21, having a horizontal plate 230 and a vertical plate 231, wherein, the horizontal plate 230 is pre-provided with a through hole 232, and that the vertical plate 231 is pre-provided with a horizontal through groove 233 served as a track of flat plate 200 of said fork 20 moving in latitudinal direction;

A knob 24 provided with circular knob part 240 and a switch pole 241, wherein, the switch pole 241 is engaged with long-hole groove 210 in the center of switch knob arm 21 after pass through the through hole 232 pre-provided on the horizontal plate 230 of said fork frame 23.

Figure 4F:
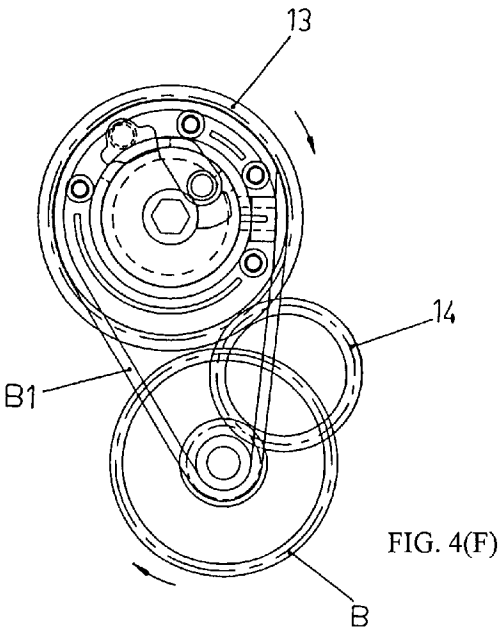
FIGS. 4(D)–(F) are plan section views showing the strip-cut shredder in operating state.
Figure 4D:
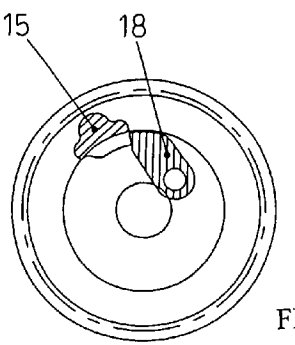
Figure 4E:
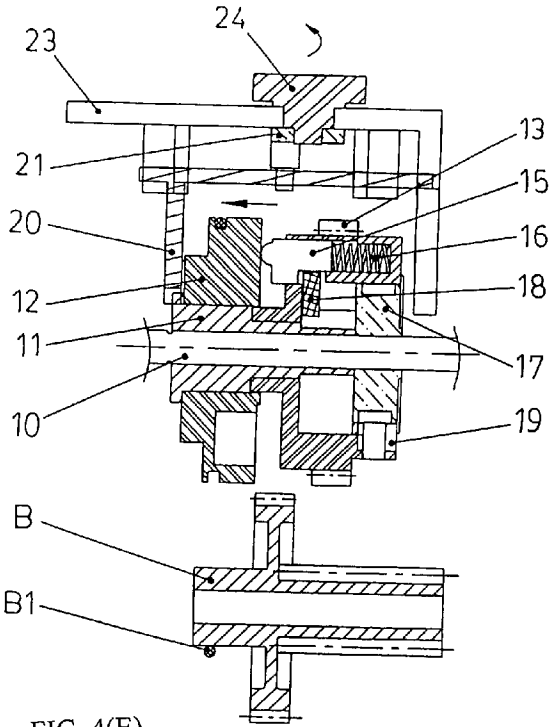

When the double-duty shredder in the operating state strip-cut shredder, please refers to the FIG. 4, side elevation view of the present invention, the left side of large strap wheel 12 not be pushed by the push force from the right movement of fork 20 but be pushed by the push forces from the drive key 15 and compressed spring 16 to make large strap wheel 12 stay in the left dead-point. So, the large strap wheel 12 disposed on the draft coat 11 of drive shat 10 and the ratchet wheel 13 do not spur the drive key 15 and pawl 18 into intermesh relationship (shown in view A), therefore the pawl wheel 17 that pawl 18 disposed and drive shaft 10 not be rotated, and the linkage mechanism that formed form the two ends of drive 10 fixed to latitude paper-cutting device C2 by crank coupler link device C1 will not act. To be brief, drive ratchet wheel 13 do not rotate driven pawl wheel 17 result in latitude paper-cutting linkage mechanism C2 not in acting state, so, only strip cutter wheel be driven by motor drive mechanism act strip cut.

Figure 5F:
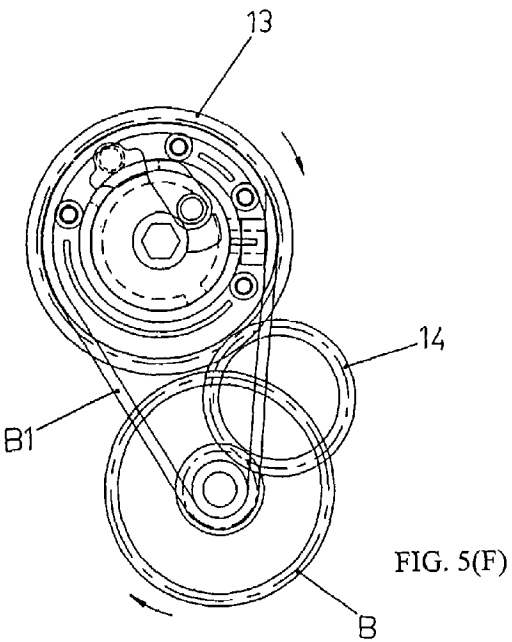
FIGS. 5(D)–(F) are plan section views showing the cross-cut shredder in operating state.
Figure 5D:
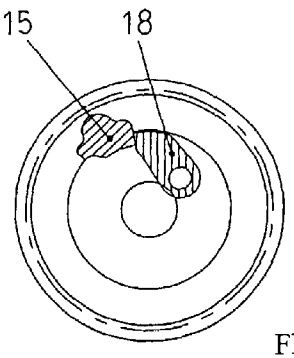
Figure 5E:
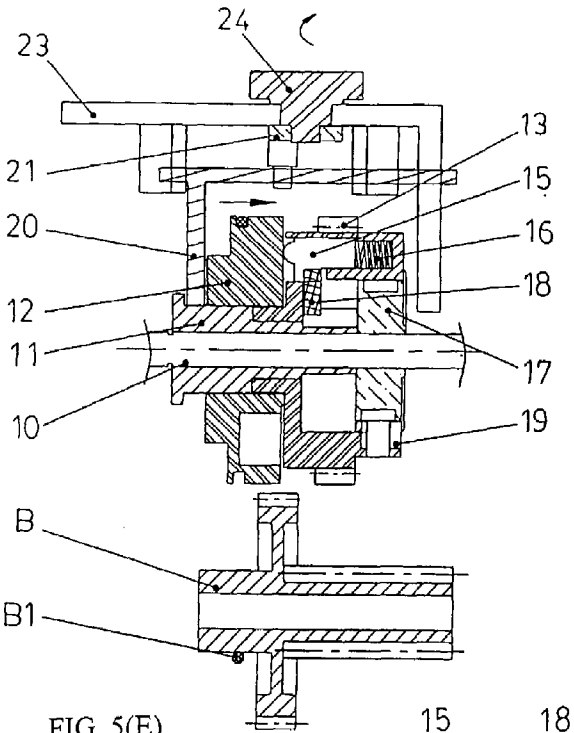

Referring now to FIG. 5, the double-duty shredder in operating state of cross-cut shredder, wherein the rotary knob 24 moves the fork 20 to the right and the large strap wheel 12 to the right, The large strap wheel 12 will compel drive key 15 move right and compress the spring 16 disposed on the right of drive key 15, drive key 15 will rotate pawl 18, pawl wheel 17 and drive wheel 10 when drive key 15 move right to intermesh with pawl 18. In other words, drive ratchet wheel 13 have rotated driven pawl wheel 17 and result in latitude paper-cutting linkage C2 in acting state, so, after the latitude paper-cutting mode act, the cross-cut shredder will meet the work require of cutting the paper to be cut coupled with strip paper-cutting mode of strip cut wheel.

We can conclude from what above-mentioned, the present invention consists of mechanical drive device and switch knob device two main bodies, wherein the mechanical drive device comprise such subassemblies: motor drive gear wheel, drive shaft, shaft coat, large strap wheel, ratchet wheel, drive key, pawl and pawl wheel, and that switch knob device comprises such subassemblies: fork, switch knob arm, fork frame, knob, and which make large strap wheel compel drive key move to the position that pawl and pawl wheel in, the pawl wheel that the pawl disposed on and drive shaft fixed to pawl wheel will be rotate together to spur the latitude paper-cutting mechanism drivingly connected with drive shaft to act the latitude paper-cut on the paper to be cut when drive key intermeshes with pawl. The present invention fulfill the paper-cut operation by using effective mechanical device switch control to decide the paper to be cut will be cut by strip paper-cutting mode or cross paper-cutting mode. The present is actually a new invention, and comply with the regulation for applying a patent.

What is claimed is:

1. A switch mechanism of double-duty shredder, comprising a mechnical drive device, a switch knob device, wherein said mechanical drive device further comprises a motor drive gear wheel having a first side provided with a small strap wheel that rotates synchronically with said motor drive gear wheel;

a drive shaft that is an axial style having a multi-angular section;

a shaft coat having a shaft hole with a multi-angular section corresponding to the multi-angular section of said drive shaft and having an outer profile with a step style configuration and provided with a first part, a second diameter part, and a third part; wherein the first part is larger in diameter than the second part, and the second part is larger in diameter than the third part;

a large strap wheel disposed on said first part of said shaft coat and movable from left to right or from right to left, and rotatable in the same direction as the motor drive wheel, said small strap wheel is disposed on the side of motor drive gear wheel;

a ratchet wheel covered around said second part and rotatable in the same direction with motor drive gear wheel by getting rotary power from motor drive gear wheel through idler wheel and provided with a through keyway on the circle;

a drive key disposed in and glidable through said through keyway, a compressed spring disposed on a first side thereof;

a pawl wheel having a shaft hole with a multi-angular section fixed to said multi-angular section of the drive shaft on the center and having a pawl corresponding to the position of said drive key;

said switch knob device further comprising a fork including a flat plate preset a groove hole and a half-circular fork frame against on a first side of said large strap wheel;

a generally inverted U-shaped switch knob arm having a long-groove hole on a center thereof and a left supporting arm passing through the long-groove hole of said fork flat plate, and a right supporting arm located on a switch knob plate corresponding to a fixed pivot;

a fork frame disposed upon said fork and said switch knob arm having a horizontal plate and a vertical plate, wherein said horizontal plate pre-set a through hole and that vertical plate pre-set a latitude through groove served as the track of said fork plat plate moving in latitude direction;

a knob having a circular knob portion and a switch pole, wherein said switch pole being accommodate in the long-hole groove of center of plate of said switch knob arm after passing through the through hole pre-set on horizontal plate of said fork frame.

* * * * *